US008038551B2

(12) United States Patent
Gazzara et al.

(10) Patent No.: US 8,038,551 B2
(45) Date of Patent: Oct. 18, 2011

(54) METHOD FOR MANUFACTURING A RACQUET FRAME FOR SPORTS RACQUET AND A RACQUET FRAME THEREOF

(75) Inventors: Roberto Gazzara, Mestre (IT); Mauro Pinaffo, Camposampiero (IT); Michele Pozzobon, Fossalunga di Vedelago (IT); Mauro Pezzato, Treviso (IT)

(73) Assignee: Prince Sports, Inc., Bordentown, NJ (US)

( * ) Notice: Subject to any disclaimer, the term of this patent is extended or adjusted under 35 U.S.C. 154(b) by 601 days.

(21) Appl. No.: 11/875,253

(22) Filed: Oct. 19, 2007

(65) Prior Publication Data

US 2008/0274843 A1 Nov. 6, 2008

(30) Foreign Application Priority Data

Oct. 20, 2006 (EP) ..... 06122718

(51) Int. Cl.
*A63B 49/02* (2006.01)
*A63B 49/10* (2006.01)

(52) U.S. Cl. ..... 473/524; 473/535

(58) Field of Classification Search ..... 473/524, 473/535, 536

See application file for complete search history.

(56) References Cited

U.S. PATENT DOCUMENTS

| | | | | |
|---|---|---|---|---|
| 3,755,037 | A * | 8/1973 | Erwin et al. | 156/185 |
| 4,194,738 | A | 3/1980 | Inoue et al. | |
| 4,399,992 | A * | 8/1983 | Molitor | 473/536 |
| 4,423,869 | A * | 1/1984 | Haines | 473/536 |
| 4,436,305 | A | 3/1984 | Fernandez | |
| 5,217,223 | A * | 6/1993 | Feeney | 473/535 |
| 6,012,996 | A * | 1/2000 | Lo | 473/547 |
| 7,273,430 | B2 * | 9/2007 | Ashino et al. | 473/535 |
| 7,309,299 | B2 * | 12/2007 | Pezzato et al. | 473/540 |
| 7,503,860 | B2 * | 3/2009 | Gazzara et al. | 473/535 |
| 7,811,500 | B2 * | 10/2010 | Gazzara et al. | 264/314 |
| 2004/0138015 | A1 * | 7/2004 | Yu | 473/535 |
| 2005/0153799 | A1 | 7/2005 | Rigoli | |
| 2006/0281590 | A1 * | 12/2006 | Ashino et al. | 473/535 |
| 2007/0123376 | A1 * | 5/2007 | Gazzara et al. | 473/524 |
| 2007/0135245 | A1 * | 6/2007 | Gazzara et al. | 473/524 |
| 2007/0238560 | A1 * | 10/2007 | Gazzara et al. | 473/516 |
| 2008/0274843 | A1 * | 11/2008 | Gazzara et al. | 473/536 |
| 2010/0160094 | A1 * | 6/2010 | Sommer | 473/524 |

FOREIGN PATENT DOCUMENTS

GB 2110977 A 6/1983

OTHER PUBLICATIONS

European Search Report issued in priority application EP06122718.

* cited by examiner

*Primary Examiner* — Raleigh W. Chiu
(74) *Attorney, Agent, or Firm* — Abelman, Frayne & Schwab

(57) ABSTRACT

A racquet frame has one or more string holes formed therein and a string bed plane, along which the string holes extend. The racquet frame is preferably formed by providing a frame bearing structure, which is aimed at providing flexural stiffness to said racquet frame, and structurally integrating the frame bearing structure with a frame binding structure, which is aimed at providing torsional stiffness to the racquet frame. The mutual integration of the frame bearing structure and the frame binding structure forms a composite frame structure, in which one or more of said string holes may be provided.

9 Claims, 10 Drawing Sheets

METHOD FOR MANUFACTURING A RACQUET FRAME FOR SPORTS RACQUET AND A RACQUET FRAME THEREOF

BACKGROUND OF THE INVENTION

The present invention relates to a method for manufacturing a racquet frame for a sports racquet, which may be, for example, a tennis, squash, badminton, racquetball, soft tennis or paddle racquet. More particularly, the present invention relates to an improved method or manufacturing a racquet frame, which allows obtaining a composite frame structure forming the racquet frame. In a further aspect, the present invention relates to an improved racquet frame for a sports racquet having a composite frame structure and string holes formed therein.

Sports racquets have a head portion containing an interwoven string bed, a handle, and a shaft portion connecting the head portion to the handle.

In traditional racquets in composite materials, the frame is generally formed by placing in a mould a prepreg tube containing an inflatable bladder. The bladder is inflated, so as to make the prepreg tube to adhere to the mould walls and, at the same time, the mould is heated, so as to cure the prepreg tube. Holes for anchoring the ends of the strings are formed in the frame by drilling small string holes in the frame after the racquet is moulded. Each of those string holes (hereinafter referred to as "traditional string holes") commonly accommodates a single string. Plastic grommet pegs, which are formed on grommet and bumper strips that extend along the outside surface of the frame, extend through the string holes to protect the strings from the sharp edges of the drilled holes.

Racquet frames, which are alternative with respect to those with traditional string holes, have been recently developed.

Co-owned PCT application WO 2004/075996 discloses a sports racquet, in which certain adjacent pairs of small string holes along the sides, tip, and throat bridge of the racquet are replaced by enlarged string port holes (hereinafter referred to as "string port holes") having two inwardly facing string bearing surfaces, which are spaced apart by a distance corresponding to the distance between two contiguous main strings or cross strings. Preferably, the frame is formed of a double tube of carbon fibre-reinforced composite material (a so-called graphite frame), in which the string port holes are moulded into, as the racquet is pressure moulded. As a result of using two tubes, each forming one-half of the string port hole, the string port holes can have rounded edges and do not necessarily require the use of grommet pegs or strips. Also, in the regions between string port holes, the adjoining walls of the two tubes are fused together to form a stiffening wall inside the frame. The result is a racquet, which has improved torsional stiffness and lighter weight. The racquet is made in a mould having a mould cavity in the desired shape of the frame. The mould has two halves. A prepreg tube containing an inflatable bladder is placed in each mould half. Mould insert members, which have an outside surface in the desired shape of the string port holes, as well as pins to form traditional string holes are positioned between the two prepreg tubes and the mould is closed. The bladders are then inflated while the mould is heated to cure the composite resin. After removing the racquet frame from the mould, the mould insert members and the pins are removed leaving string port holes and traditional string holes, respectively.

Co-owned European patent application EP 06112486.3 discloses a sports racquet, in which a racquet frame with string port holes is formed using a single frame tube. In this case, a single mouldable structure is provided from a prepreg tube. Said structure contains a couple of co-axial prepreg inflatable bladders and a plurality of cross-channels, which transversally pass through the single tube structure at an intermediate region. The cross-channels have position and orientation corresponding to the position and orientation of the string port holes to be formed in the racquet frame. The tube structure is placed in a mould and mould members are inserted into the cross channels. The bladders are then pressurized and the tube structure conforms to the shape of the mould. The mould is heated, so that the tube structure cures. This manufacturing method is clearly intended to constitute an improvement, since a single moulding operation is adopted. This allows improving the quality of the racquet frames and obtaining a reduction of the overall manufacturing costs.

Although the above described manufacturing methods have shown to be effective for industrial manufacturing racquet frames with traditional holes or with string port holes, it has been seen that production costs are still relatively high, due to a multiplicity of factors.

First of all, these methods still entail a certain number of process steps, which is quite difficult to aggregate/reduce in order to save manufacturing time and costs. In fact, they are adopted inflating moulding techniques, which are relatively expensive and time consuming. For example, inflatable bladders have always to be positioned into the mouldable structure, so as to ensure upon pressurization the adhesion of the mouldable structure to the walls of the mould. This operation can be difficultly automated and very often it requires human intervention.

Further, the described manufacturing methods generally use mouldable tube structures and bladders, which are made of prepreg tubes with a high content of carbon fibres. It is known that carbon fibres are a relatively expensive material, the cost of which has been remarkably increasing in the recent years. This fact necessarily entails higher purchasing costs for providing the basic crude materials for manufacturing the racquet frame.

Moreover, the use of inflatable bladders makes it difficult to obtain additional holes or recesses (hereinafter referred to as "additional cavities") on the racquet frame, which might be used for better accommodating bumpers or other plastic inserts, thereby improving the racquet frame structural performances. As for the traditional string holes these cavities might be drilled after the frame is formed. Unfortunately, the common practice has shown that drilling the string holes or the additional cavities is a kind of post-curing operation on the moulded racquet frame, which should be avoided since it may weaken the moulded frame, given the fact that the frame fibres are broken. In addition, this kind of operation requires time and that remarkably enhances the number of scrap frames.

SUMMARY OF THE INVENTION

The present invention provides an improved method for manufacturing a racquet frame, which allows overcoming the mentioned drawbacks.

More particularly, the present invention provides an improved method of manufacturing a racquet frame, in which it is possible to avoid the use of prepreg bladders or tubes, thereby optimizing or even reducing to zero the content of carbon fibres in the racquet frame.

The invention further provides an improved method of manufacturing a racquet frame, which easily allows the obtaining of traditional string holes and/or string port holes and/or additional cavities without drilling the racquet frame after it is formed.

The invention also easily allows the obtaining of frame regions made of different materials, thereby optimising/improving the structural performances of the racquet frame.

The invention is easy to carry out at industrial level with relatively low costs.

The present invention comprises a racquet frame having a composite frame structure, which is the result of a mutual integration of different frame structures, that is to say a frame bearing structure and a frame binding structure.

The frame bearing structure is aimed at mainly providing flexural stiffness to the racquet frame. This is quite important in order to have a proper flexural response of the racquet frame and obtaining high performances, when the ball hits the racquet string bed. The frame bearing structure provides also a certain resistance to mechanical stresses, which, for example, does not allow the string tension to deform the racquet frame.

The frame binding structure is solidly connected to the frame bearing structure. The frame binding structure may be aimed at providing torsional stiffness to the racquet frame, so as to have an improved resistance to torsion, shear and compression. The frame binding structure may also provide structural support to the frame bearing structure. For example, it may be used to maintain in position and in mechanical connection some portions of the frame bearing structure. The frame binding structure may be simply used as a piece of material, which is associated to the frame bearing structure for facilitating the obtaining of traditional string holes and/or string port holes and/or additional cavities and/or regions with different materials during the mutual integration with the frame bearing structure.

In conventional racquets, the racquet frame is commonly designed and realized as a whole in the attempt of achieving the desired performances for the sports racquet. Instead, the present invention provides a completely different and innovative manufacturing approach. The racquet frame is conceptually considered as split in different frame structures, which are separately conceived and subsequently integrated. The capabilities of each frame structure can therefore be optimized, so as to achieve improved and specific performances and provide a synergetic effect when the mutual integration is realized. This allows obtaining higher quality and higher performance racquets. For example, it is possible to magnify the intrinsic advantages deriving from the use of string port holes.

The innovative manufacturing approach proposed by the present invention provides other important advantages, which are extremely difficult to achieve with conventional manufacturing methods and racquets.

The manufacturing process can be simplified, since conventional inflation moulding techniques are not required. Lower cost assembling/moulding techniques steps can be effectively considered for manufacturing the racquet frame. More particularly, according to the present invention, it is much easier to obtain the string holes and/or additional cavities on the frame. Therefore, lower time and production costs are entailed, hi addition, the use of carbon fibre materials can be optimized or even reduced to zero and therefore the costs of the crude materials for manufacturing the racquet frame can be substantially reduced.

Other features and advantages of the present invention will become apparent from the following description of preferred embodiments, taken in conjunction with the drawings.

DETAILED DESCRIPTION OF THE PREFERRED EMBODIMENTS

Figure 1:
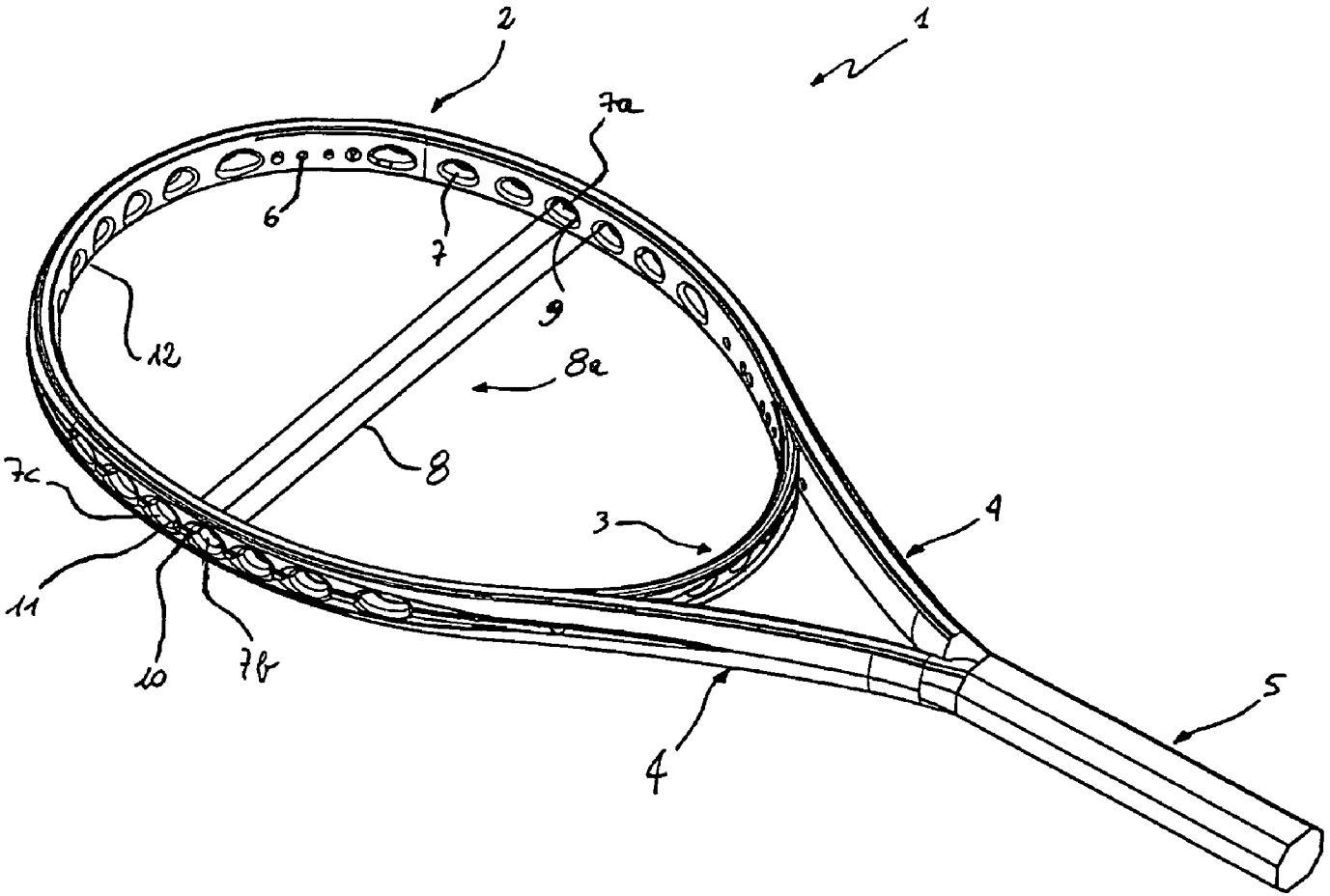
FIG. 1 is a perspective view of a racquet frame manufactured by the method, according to the present invention.

Referring to the cited figures, in FIG. 1 it is shown a first embodiment of a racquet frame 1 manufactured with the method, according to the present invention. The racquet frame 1 includes a head portion 2, which includes a throat bridge 3 and a tip 12, a pair of converging shafts 4, and a handle portion 5. The head portion 2 includes a plurality of traditional string holes 6 and a plurality of consecutive string port holes 7. A handle (not shown) is mounted on the handle portion 5, and thereafter the handle may be wrapped with a grip. As described in greater detail in WO 2004/075996, which is incorporated herein by reference, the string port holes 7 on opposite sides of the head 2, as well as opposed port string holes in the tip 12 and throat bridge 3, are offset relative to one another. In this manner, e.g., along the sides, a string segment 8, which bears against the lower bearing surface 9 of one port string hole 7*a*, after crossing the string bed 8*a*, bears against the upper bearing surface 10 of the string port hole 7*b*, wraps around the outside surface of the head 2, and bears against the lower bearing surface 11 of the next adjacent port string hole 7*c* before again crossing the string bed. Such stringing is used both for the cross strings 8 and the interwoven main strings (not shown). The interwoven main and cross strings form a string bed 8*a* laying substantially on a string bed plane 8*b* (FIG. 3*b*), along which the string holes 6 or 7 extend.

The method for manufacturing the racquet frame 1 may be used to manufacture also racquet frames having only traditional string holes 6.

In one embodiment, the method a step a) of providing a frame bearing structure 21, which comprises one or more bearing portions 210 substantially aimed at providing flexural stiffness to the racquet frame 2. The bearing portions are preferably constituted by elongated elements 210. In fact, in a preferred embodiment, the mentioned step a) comprises a sub-step a.1) of providing one or more elongated elements 210 and a sub-step a.2) of shaping and/or assembling the elongated elements 210, to form the frame bearing structure 21.

The elongated elements 210 are advantageously made of a relatively stiff material. Various materials, useful for providing a certain structural stiffness, may be considered, such as, for example, carbon fibres, thermoplastic or thermosetting resins, carbon epoxies, aluminum, magnesium, titanium, steel, glass fibre, nano-structured materials, natural fibres (e.g. wood), SMC (Sheet Moulding Compounds), BMC (Bulk Moulding Compound).

Figure 3A:
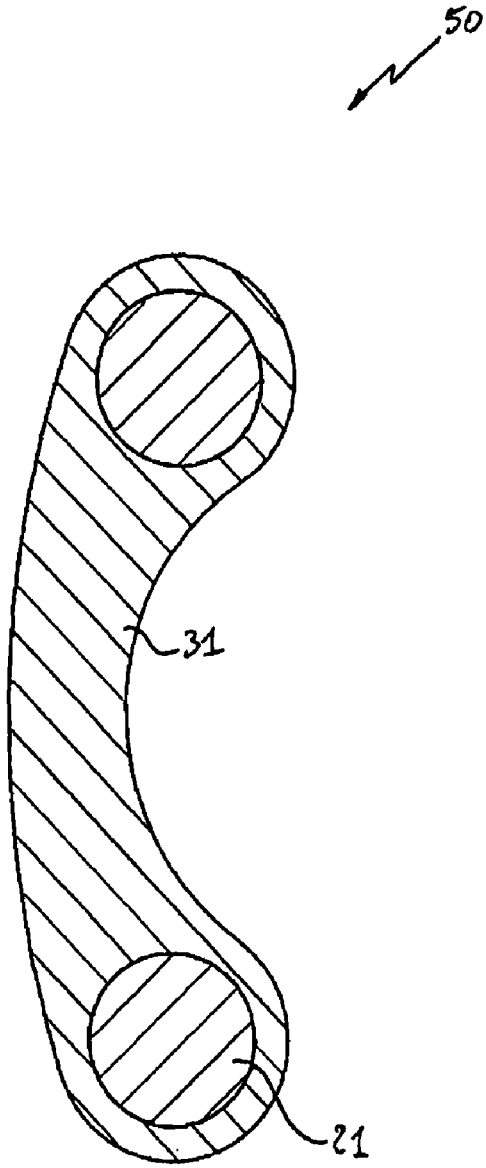
FIG. 3A is a cross section view of the composite frame structure shown in FIG. 2, along the section plane AA'.
Figure 3B:
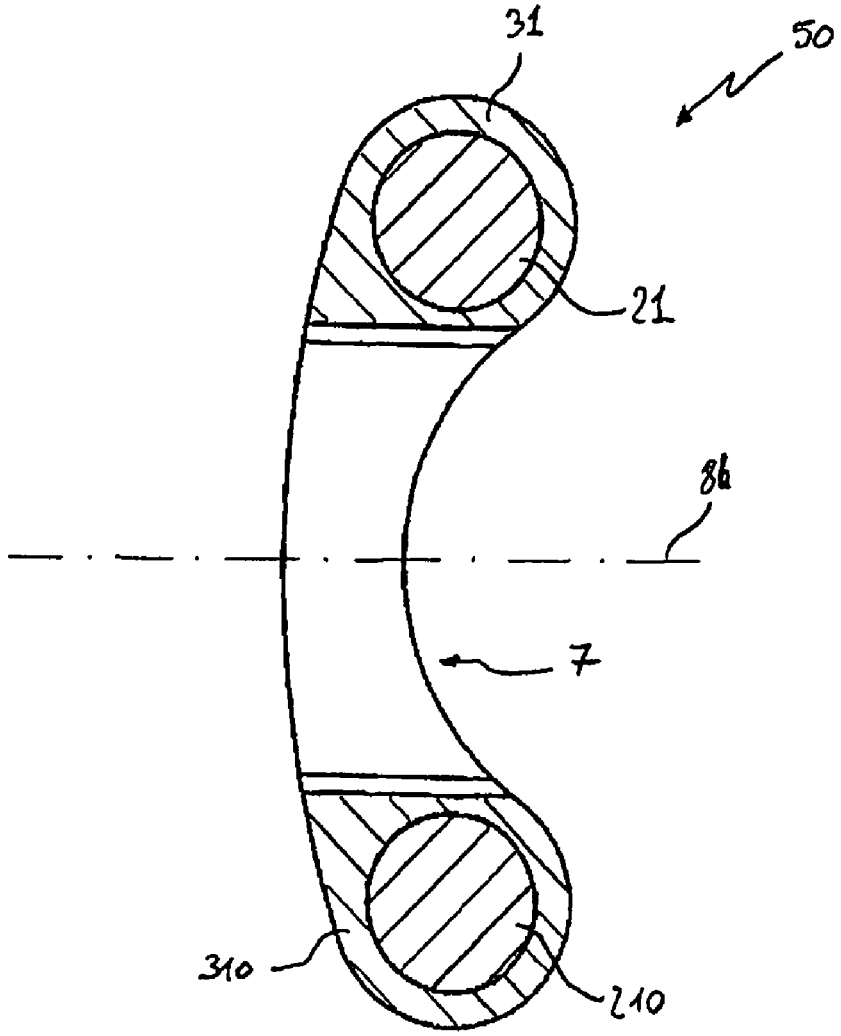
FIG. 3B is a cross section view of the composite frame structure shown in FIG. 2, along the section plane BB'.
Figure 4:
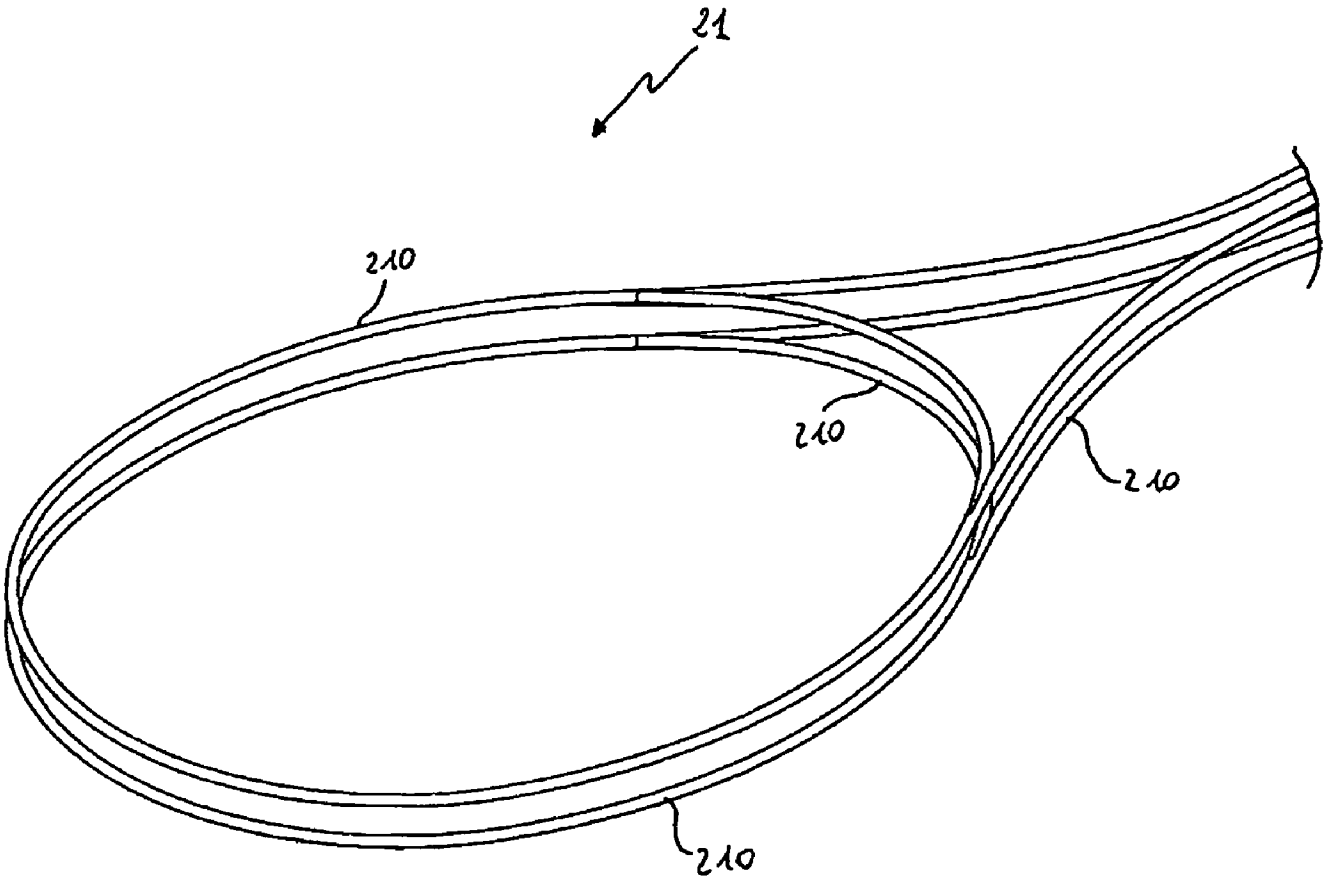
FIG. 4 is a perspective view of an embodiment of a frame bearing structure for the composite frame structure of FIG. 2.
Figure 5:
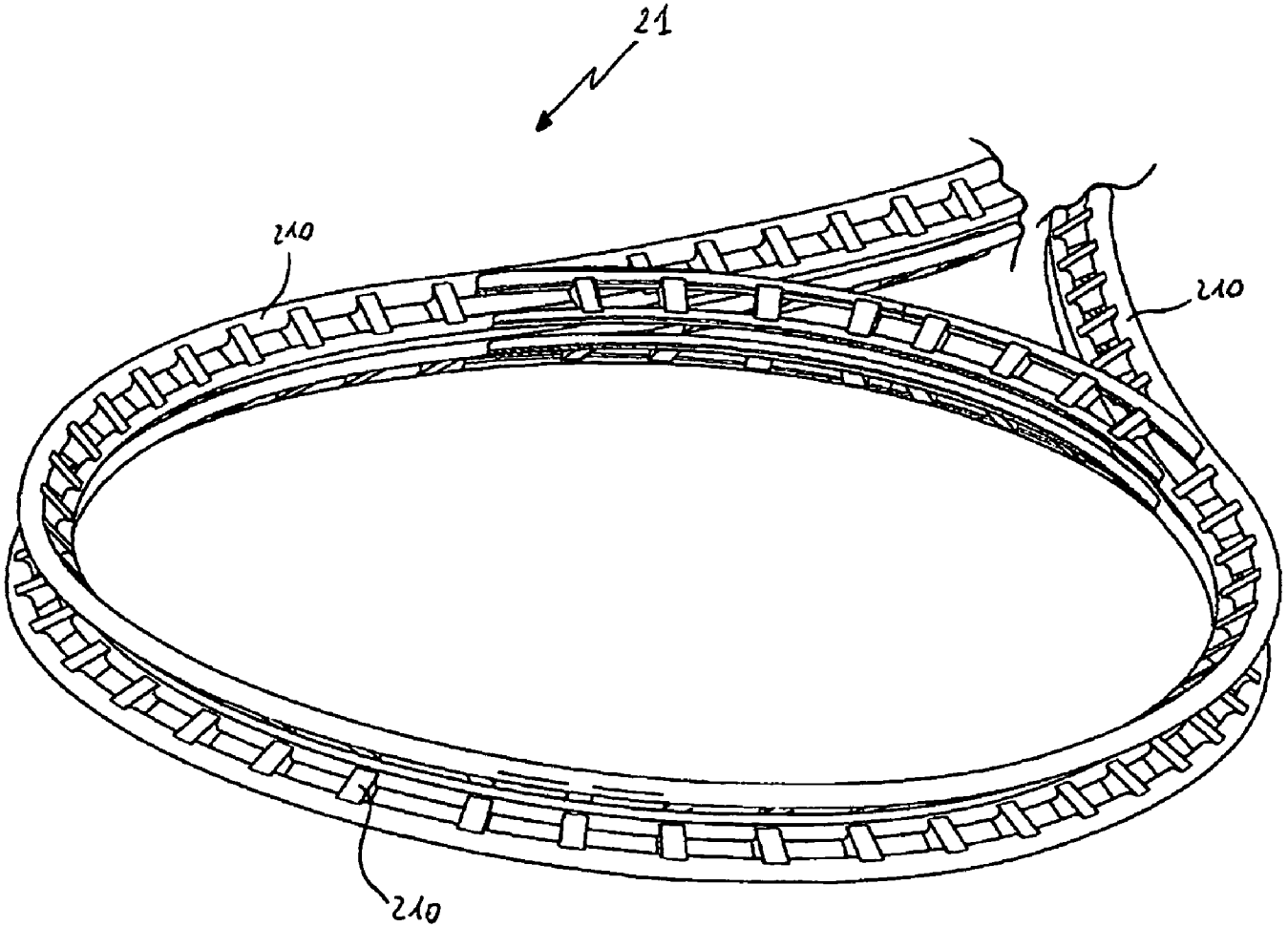
FIG. 5 is a perspective view of another embodiment of a frame bearing structure for the composite frame structure of FIG. 2.
Figure 6:
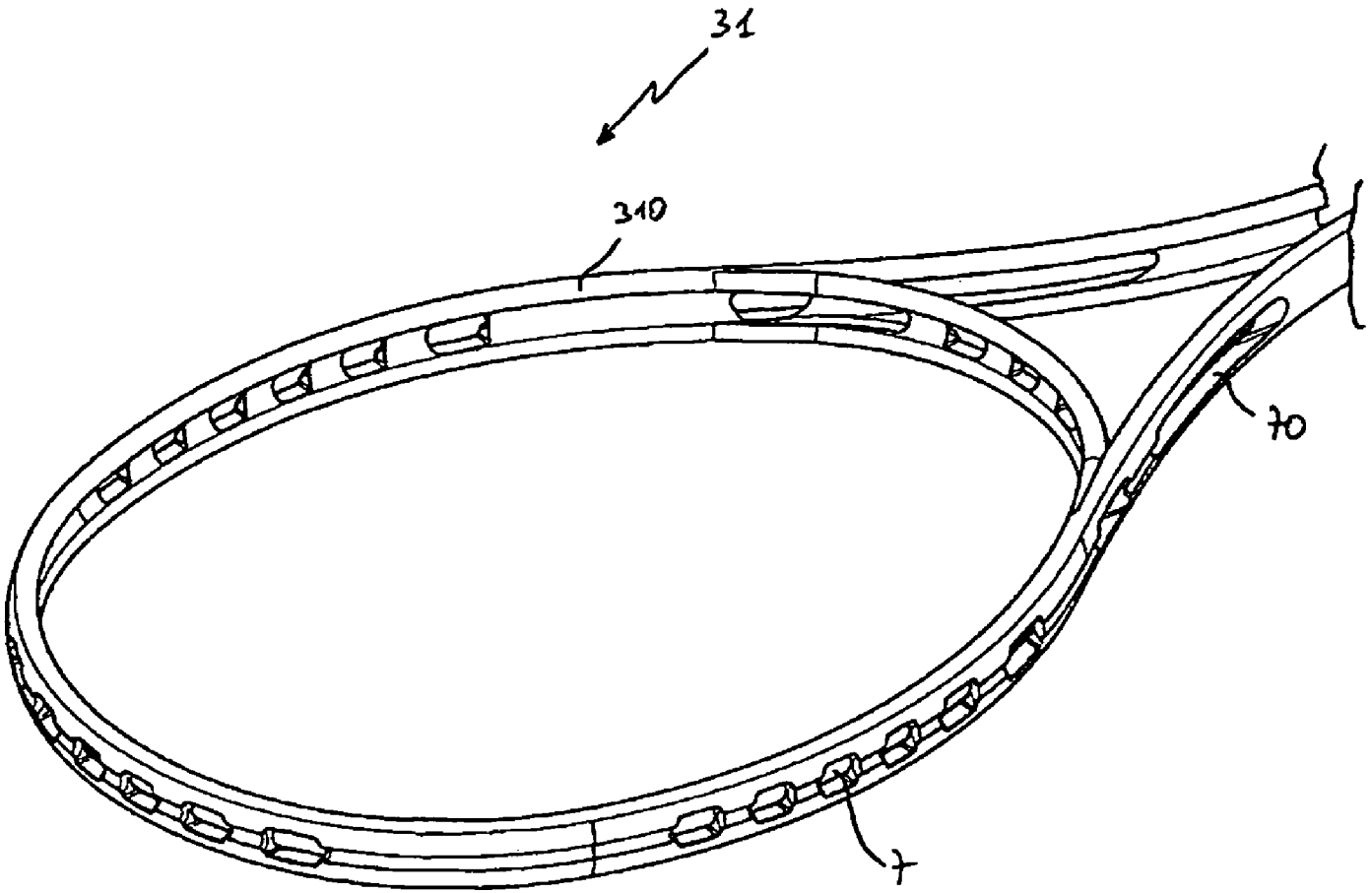
FIG. 6 is a perspective view of an embodiment of a frame binding structure for the composite frame structure of FIG. 2.

The elongated elements 210 may be oriented according to different planes, depending on the structural stiffness distribution, which has to be conferred to the racquet frame 1 by the frame bearing structure 21. For example, the elongated elements 210 can be contained in one or more planes substantially parallel to the string bed plane 8*b*, as shown in FIGS. 3B-4. The elongated elements 210 may be also oriented along one or more planes, which intersect the string bed plane 8*a*. In particular, the elongated elements 210 may be shaped/assembled, so as to form a reticular structure, as shown in FIG. 5. More in general, a single elongated element 210 may extend according to any direction in the three-dimensional space, i.e. it may form any angles with the string bed plane 8*a*.

As shown in the cited figures, the elongated elements 210 have preferably the shape of an elongated tube with solid or hollow portions. In alternative, other shapes such as a "double T" shape or a laminar shape (FIG. 8) are possible.

The actual geometric shape of the elongated elements may be any. Thus, they can reproduce the final shape of certain portions of the racquet frame 1 (see the elements 210B of FIG. 8) or the shape of the string port holes 7 (see the elements 210A of FIG. 7).

Practical implementation of the step a.1) may entail various manufacturing techniques, according to the shape of the elongated elements 210 and the materials used thereof. For example, if carbon fibres are used, the elongated elements 210 may be obtained by means of filament or tape winding. Alternatively, if metallic or plastic materials are used, extrusion, forging, pultrusion, moulding, thermoforming or other suitable manufacturing techniques may be considered.

Also for the practical assembling/shaping the elongated elements (step a.2)), various techniques, such as for example soldering or forging, may be adopted, according to manufacturing preferences.

The manufacturing method, according to the present invention, comprises also the step b) of structurally integrating the frame bearing structure 21 with a frame binding structure 31, which is associated to the frame bearing structure 21.

Such mutual integration provide a solid mutual connection between the two frame structures 21 and 31. As it will be seen in the following, such a mutual connection may not be a permanent connection.

Figure 2:
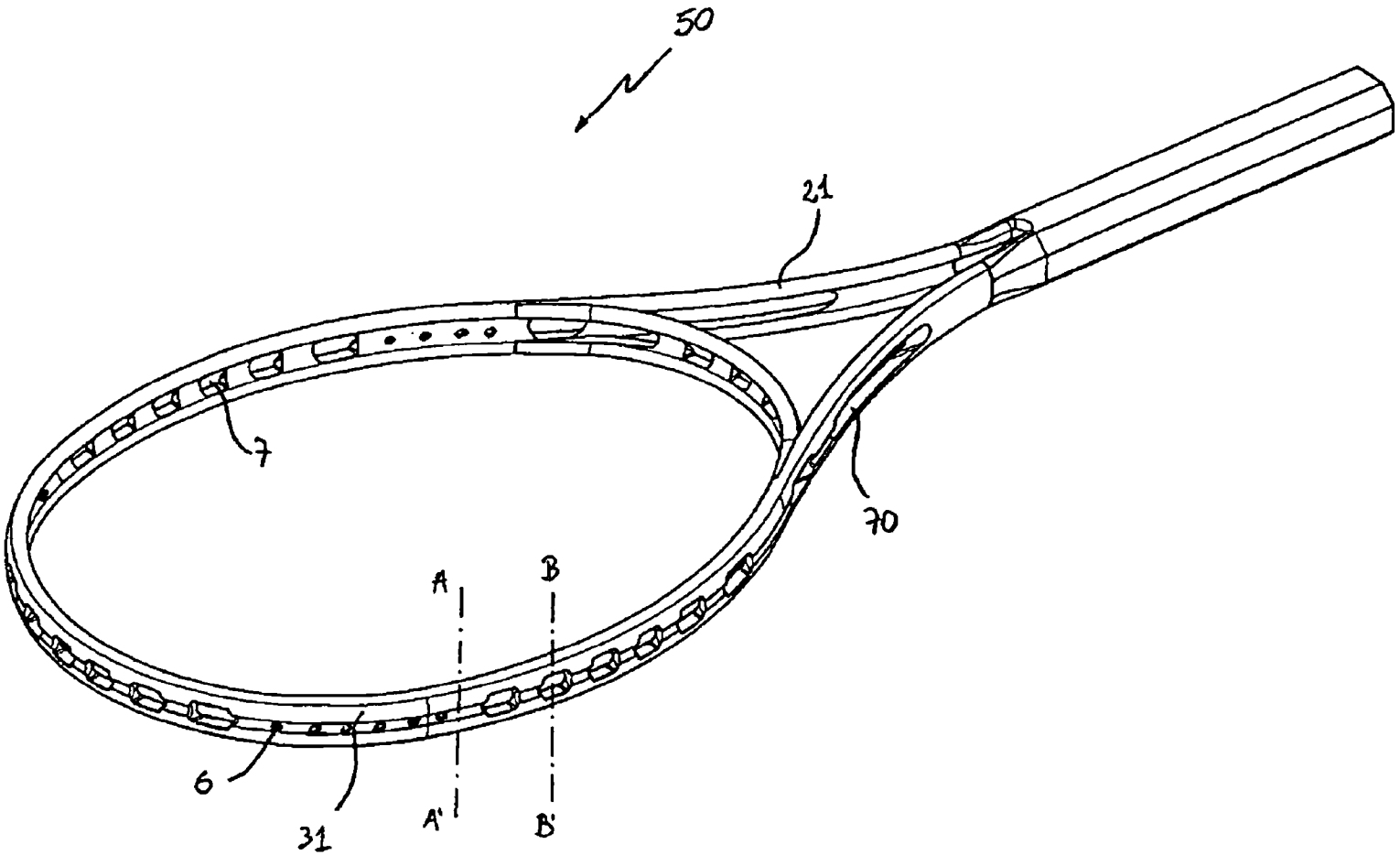
FIG. 2 is a perspective view of an embodiment of a composite frame structure, related to the racquet frame shown in FIG. 1.

The mutual structural integration of the frame bearing structure 21 and the frame binding structure 31 forms the composite frame structure 50, shown in FIG. 2. As it is possible to notice, the composite frame structure 50 is already provided with the string holes 6 or 7. The composite frame structure 50 basically constitutes the final structure for the racquet frame 1. In principle, no additional manufacturing steps are needed and the racquet frame 1 can directly be sent to the usual final arrangements, such as, for example, the insertion of grommet or bumper strips. In fact, as it will be better seen in the following, the mentioned step b) may comprise advantageous sub-steps for realizing any relevant structural portions of the racquet frame 1, including also the most external layers, which are generally used for decorative purposes only.

Preferably, the frame binding structure 31 provides a structural support and connection for one or more portions of the bearing structure 21, in particular for the elongated elements 210. Further, the frame binding structure 31 provides preferably a structural support for the string bed plane 8*b*. This means that preferably the string holes 6 or 7 are directly formed on the frame binding structure 31. Nevertheless, it is to be noticed that it is possible to form the string holes 6 or 7 only on the frame bearing structure 21, for example by assembling a proper reticular structure at the described manufacturing sub-step a.2).

Preferably, one or more portions 310 of the frame binding structure 31 are made of one or more relatively elastically deformable materials, such as for example, thermoplastic materials, polycarbonates, polyurethanes, loaded polymers, natural materials (e.g. wood), foams, structured honeycomb layers.

Various manufacturing sub-steps are possible for the practical implementation of the described step b), the nature of which particularly depends on the materials used for the frame binding structure 31.

Figure 8:
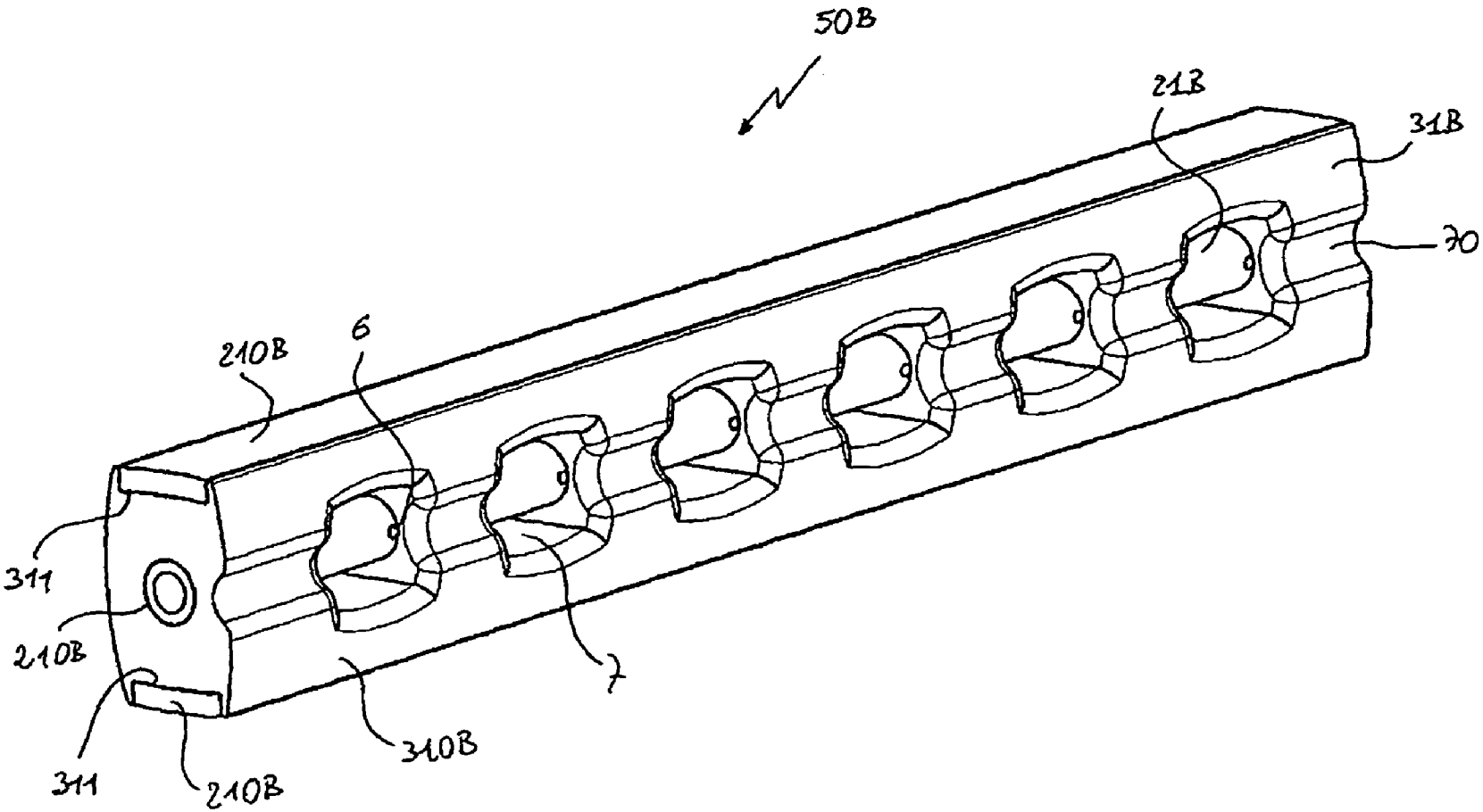
FIG. 8 is a perspective view of a portion of another racquet frame, manufactured by the method, according to the present invention.

According to a first embodiment of the present invention, the manufacturing step b) comprises preferably the sub-step b.1) of forming the frame binding portions 310 and the sub-step b.2) of assembling the frame binding portions 310 with one or more elongated elements 210 of the frame bearing structure 21. Sub-steps b.1)-b.2) provide the option, according to which the frame binding portion is separately realized and subsequently assembled with the frame bearing structure 21, thereby achieving the mutual integration of the two frame structures. For example, in the step b.1) the frame portions 310 may be separately manufactured/shaped, so as to comprise one or more cavities 311, into which the elongated elements 210 are subsequently inserted at the sub-step b.2). The cavities 311 can for example be obtained on the front or the back racquet surface as shown in FIG. 8.

The sub-steps b.1)-b.2) are particularly useful when moulding techniques cannot be adopted in step b), due to any possible reasons (e.g. the nature of the materials used for the frame binding structure 31). Moreover, sub-steps b.1)-b.2) make it possible to realise composite structures (not shown), in which one or more elongated elements 210 can be substituted, as desired, even when the racquet frame is already formed. Thus, the user himself might be able to change the set-up of the racquet frame, according to the needs.

Nevertheless, low cost moulding techniques are preferably entailed for the practical implementation of step b), when this is possible. In particular, according to another preferred embodiment of the present invention, an injection moulding technique is preferably considered. This choice entails remarkable advantages. First, injection moulding makes it possible to remarkably reduce the overall production time and, at the same time, it is significantly less expensive than the known inflation moulding techniques. Secondly, injection moulding techniques are intrinsically very flexible and they allow the easily obtaining of high quality structural solutions for the frame binding structure. For example, in a same frame section, it is possible to over-inject multiple layers of different materials, for example to realise a bumper structure. As a further example, it is also possible co-inject different regions of different materials or with different local properties, for example with different local stiffness. This allows to properly designing the mechanical properties and performances of any portion of frame.

According to this preferred embodiment, a sub-step b.3) of placing the frame bearing structure 21 within a mould is advantageously provided. The mould can be conveniently shaped, so as to keep the elongated elements 210 in their proper relative positions. Then, it is preferably executed the sub-step b.4) of placing one or more first mould members within the mould, which are aimed at defining the string holes 6 or 7. Also the step b.5) of placing one or more second mould members within the mould, which are aimed at defining one or more additional cavities 70 on the racquet frame 1, is advantageously adopted. This sub-step is particularly useful, when the racquet frame 1 (and in particular the binding structure 21) needs some holes or recesses for the insertion of additional elements, such as grommets or bumpers.

The sub-steps b.4)-b.5) are preferably adopted when the string holes 6 or 7 and the cavities 70 are not solely obtained in the frame bearing structure 21, at the above described step a).

In alternative to the insertion of the first and second mould members, the mould itself can be advantageously shaped, so as to obtain the string holes 6 or 7 and, possibly, the cavities 70 on the frame binding portion 21.

Also racquet frame decorations and cosmetics can be integrally realized with the composite frame structure 50, thereby saving further time and costs. Thus, the step b) preferably comprises also the sub-step b.6) of placing one or more shaped sheets of first materials within the mould, which are aimed at forming one or more external layers (not shown) of the racquet frame 1. Said layers are realized for improving the aesthetic appearance of the racquet frame 1. The sheets of first materials are preferably thermoformed sheets, which are placed so as to adhere to the internal walls of the mould. Preferably, these sheets are provided with at least two layers. An external layer is in contact with the walls of the mould and it is preferably made of a relatively rigid material, which does not merge during the injection moulding process and which decorates the surface of the racquet frame. An internal layer is instead preferably made of a thermoplastic material, which merges with the materials to be injected or reacted within the mould. Thus, the adhesion of the decorating sheets to the composite frame structure is guaranteed.

Then, it is provided a sub-step b.7) of injecting one or more second materials, preferably thermoplastic materials, within the mould. The injected materials flow into the mould and occupy any free cavities of the mould. When the mould is cooled, the injected materials become solid and the frame binding structure 31 is formed, being structurally joined with the frame bearing structure 21, so as to provide mutual integration. At this point, the mould can be opened and the composite frame structure 50 can be extracted from the mould.

An alternative moulding technique may be used when it is desired to have a foamed or honeycomb frame binding structure 31.

In this case, after one of the described sub-steps b.3)-b.6), a sub-step b.8) of placing one or more third reactant materials within the mould can be advantageously executed. This step is then followed by a sub-step b.9) of reacting the third reactant materials within the mould. The reacted materials expand inside the mould and occupy any free cavities. When the mould is cooled, the expanded materials become solid. Thus, the frame binding structure 21 is formed and joined with the frame bearing structure 31, so as to provide mutual integration. At this point, the mould can be opened and the composite frame structure 50 can be extracted from the mould The foregoing represents preferred embodiments of the invention. Variations and modifications will be apparent to persons skilled in the art, without departing from the inventive concepts disclosed herein.

Figure 7:
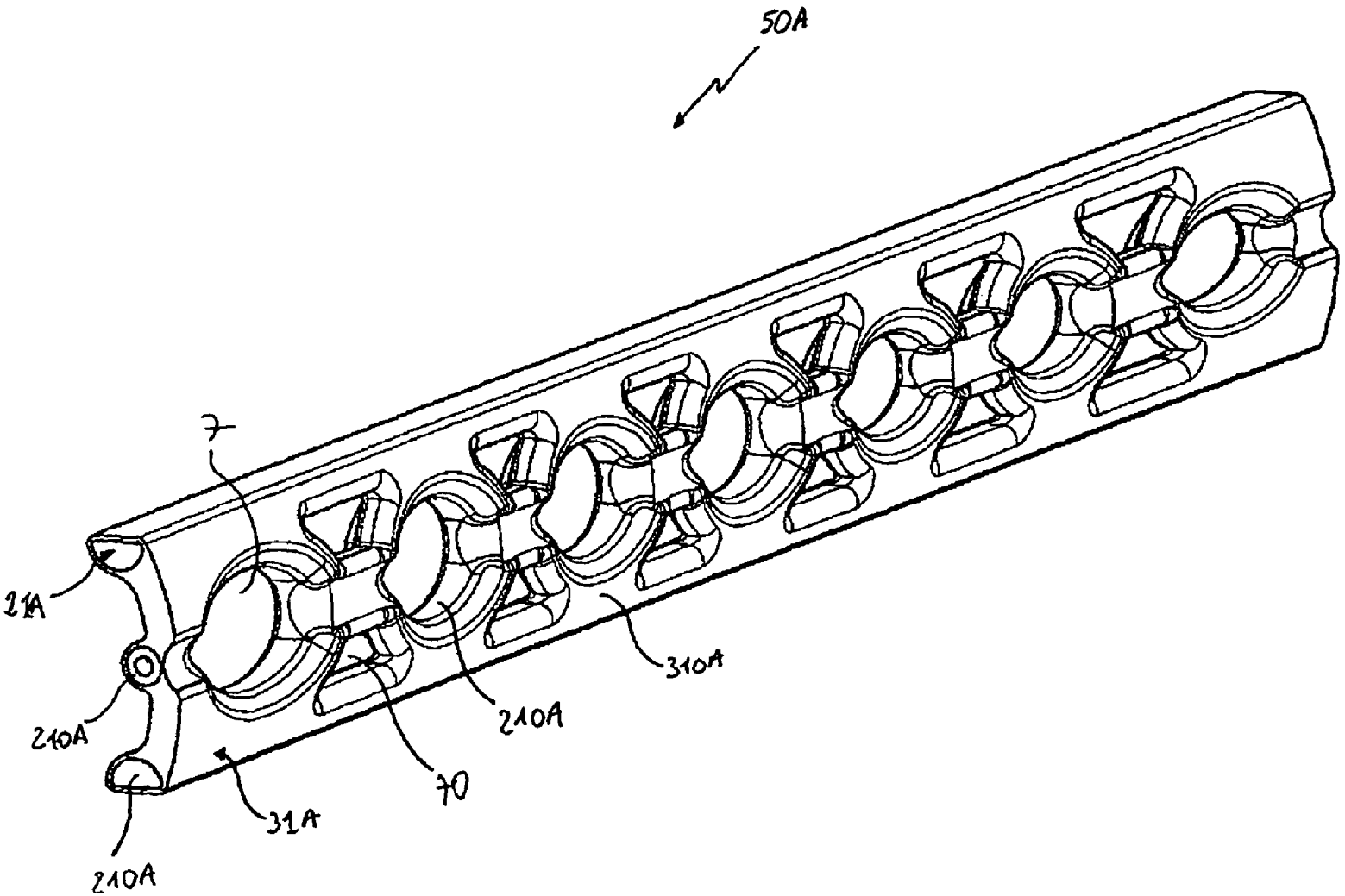
FIG. 7 is a perspective view of a portion of another racquet frame, manufactured by the method, according to the present invention.

For example, in FIG. 7 it is shown a portion of a composite structure 50A, which is related to an alternative embodiment of the racquet frame, according to the present invention. The composite structure 50A solely comprises string port holes 7 and a series of cavities 70, which pass through the entire section of the composite frame structure 50A. These cavities are positioned between two subsequent string port holes 7, symmetrically with respect to the string bed plane 8*b*. The frame bearing structure 21A comprises three elongated elements 310A, which develop substantially around the string bed 8*a*. The central elongated element is advantageously shaped to define the string port holes 7. The passing through cavities 70 are obtained in the frame binding structure 31A, the portions 310 of which keep in position and surround the elongated elements 210A.

In FIG. 8, it is shown a portion of another composite structure 50B, which is related to another alternative embodiment of the racquet frame, according to the present invention. The bearing structure 21B still comprises three elongated elements 310B, which develop substantially around the string bed 8*a*. Two elongated elements 210B have a laminar shape while a third central elongated element has a tubular shape and longitudinally crosses the string port holes 7, along the string bed plane. Traditional string holes are obtained on this central elongated element 210B, so as to allow the strings to pass through it. The frame binding structure 31*b* comprises the string port holes 7 and a longitudinal cavity 70 for accommodating the strings, when they loop externally to the frame.

Figure 9:
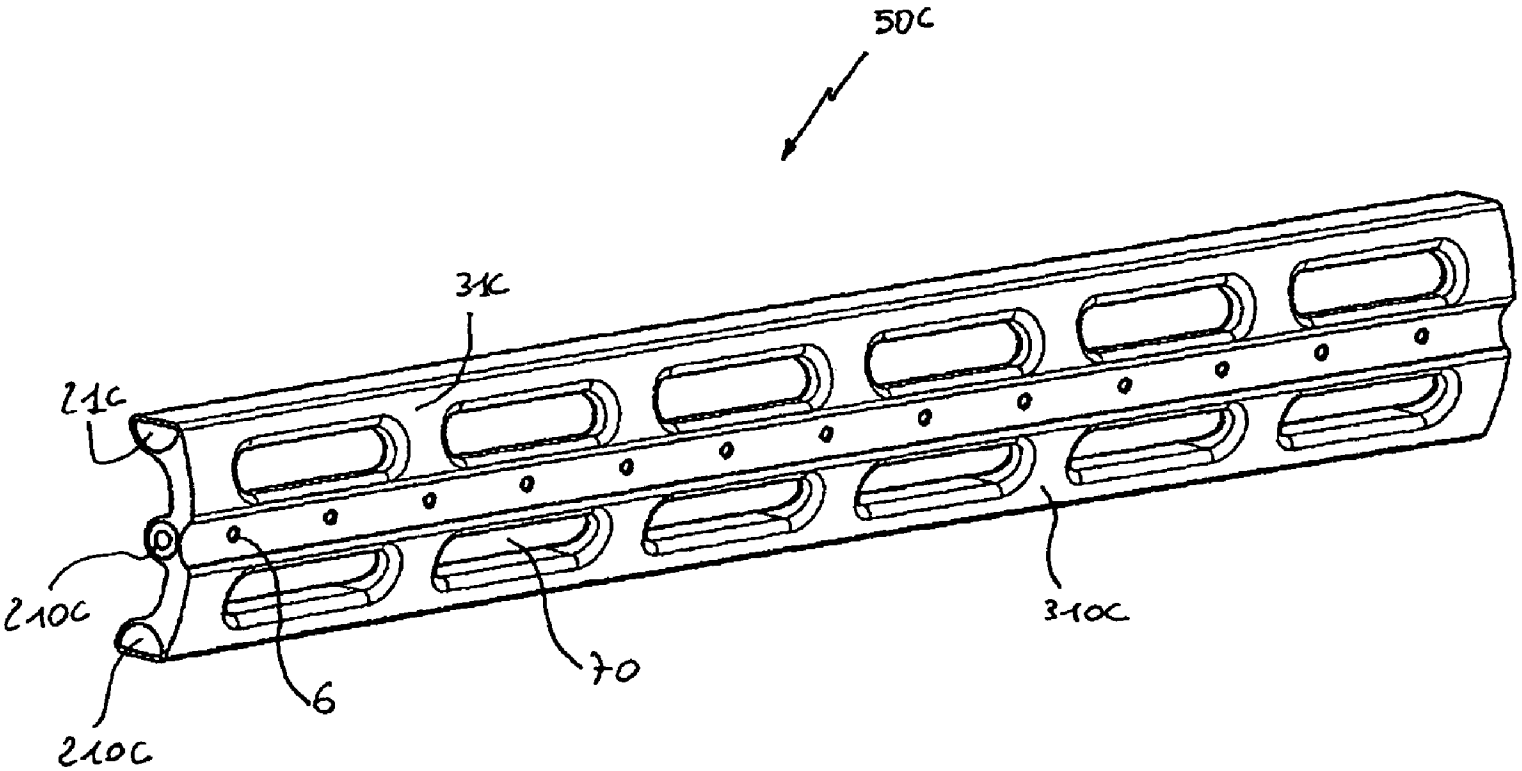
FIG. 9 is a perspective view of a portion of another racquet frame, manufactured by the method, according to the present invention.

In FIG. 9, it is shown a portion of a further composite structure 50C, which is related to a further alternative embodiment of the racquet frame, according to the present invention. In this case, the composite structure 50A comprises only traditional string holes 6, which are obtained on an elongated central element 210C and on the frame binding structure portions 310C. A series of cavities 70, which pass through the entire section of the composite frame structure 50C, are obtained in the frame binding structure 31C, so as to provide the racquet frame with lower weight and improved aerodynamics effects. The cavities 70 may be parallel or not and they may have any shape, according to the needs.

Other variations or modifications on the string holes are possible, according to the needs. For example, the string port holes 7 may have a round, oval, or otherwise curved cross sectional shape or other shapes such as rectangular shape. The string port holes 7 may have a main longitudinal axis along the string bed plane 8*b*, which may be differently angled with respect to the main longitudinal axis of the racquet frame 1, according to the needs. The method, according to the present invention may be adopted for manufacturing any portion of the racquet frame 1.

Thus, it may be used to manufacture portions of the head 2, of the throat bridge 3, of the shafts 4 and of the handle 5 of the racquet frame 1.

The method according to the present invention allows achieving the intended aim and objects. Traditional holes, string port holes and additional cavities on the racquet frame are easily obtainable with the method according to the present invention, without incurring in drilling or other post-curing operations. This allows the overall weight of the racquet to be reduced, makes stringing easier, improves performance/comfort of the racquet and reduces production costs. The manufacturing method, according to the present invention, allows avoiding expensive inflatable moulding techniques. Thus, production time and costs can be remarkably reduced. The method, according to the present invention, allows to remarkably lower or reduce to zero the content of carbon fibres in the racquet frame, thereby reducing the costs of the crude materials for manufacturing it. If carbon fibres are used, they can be concentrated into the frame bearing structure 21. Thus, higher performances can be achieved with a lower quantity of carbon fibres.

The method according to the present invention is characterized by a high level of flexibility. It is possible to easily provide a racquet frame with regions of different materials, particularly at the string holes, different shapes and different mechanical performances. This fact provides remarkable advantages in terms of cost/time reduction and of quality improvements of the racquet frame.

The method according to the present invention can be carried out in a simple manner, which is particularly suitable for industrial implementation and highly automated processing, thereby minimizing human interventions. The method according to the present invention allows using the most innovative automatic designing techniques for designing the racquet frame, thereby avoiding empiric design techniques, which are still adopted for traditional racquets. These features allow further reducing the production costs of the racquet frame. In addition, it is possible to improve the overall quality of the frames and reduce the number of frames to be rejected, due to manufacturing defects.

The method, according to the present invention, allows also manufacturing the cosmetics of the racquet frame, without the need of additional processing steps. This feature allows also implementing innovative decorating solutions, which remarkably improve the aesthetic appearance of the racquet frame, thereby making the sports racquet more attractive for the final consumer.

The invention claimed is:

1. A sports racquet frame having a head portion for securing strings in a string bed plane and a handle portion coupled to said head portion, said head portion including an outer head portion and a throat portion connecting lower ends of said outer head portion and enclosing a string bed area;

wherein said head portion comprises a pair of bearing members and a binding structure;

wherein each bearing member extending continuously through said outer head portion;

wherein said binding structure extends between said bearing members;

wherein said bearing members are supported, mechanically connected, and maintained in position by said binding structure;

wherein said bearing members are formed of at least one relatively rigid material providing flexural stiffness; and wherein said binding structure is formed of a material different from said bearing members for providing torsional stiffness to said frame.

2. The sports racquet frame of claim 1, wherein said binding structure includes securing portions, each securing portion securing one bearing member, and a web portion connecting said securing portions and having string holes for securing strings.

3. The sports racquet frame of claim 2, wherein some of said string holes are in the form of ports having opposed surfaces forming bearing surfaces for two string segments.

4. The sports racquet frame of claim 2, wherein said bearing members are solid or hollow tubes embedded in said securing portions.

5. The sports racquet frame of claim 2, wherein said securing portions have oppositely facing upper and lower grooves, which lie in planes parallel to the string bed plane above and below said string bed plane, respectively, and wherein said bearing members are in the form of elongated elements secured in said grooves.

6. The sports racquet frame of claim 2, wherein said throat portion comprises a second pair of bearing members secured in an additional binding structure on opposite sides of, and in planes parallel to, the string bed plane.

7. The sports racquet frame of claim 2, wherein said web portion includes additional openings therethrough.

8. The sports racquet frame of claim 2, wherein said frame further comprises said head portion to said handle portion, and wherein each bearing member extends continuously through one shaft, said outer head portion, and the other shaft.

9. The sports racquet frame of claim 2, wherein said bearing members are secured in said binding structure so that said bearing members lie on opposite sides of the string bed plane, in planes parallel to the string bed plane, and so that said bearing members are connected to one another solely through said binding structure.

* * * * *